United States Patent [19]

Wesley

[11] 4,278,212

[45] Jul. 14, 1981

[54] WATER SKIING TOW APPARATUS

[76] Inventor: Ronald E. Wesley, 11364 Klinger, Hamtramck, Mich. 48212

[21] Appl. No.: 749,829

[22] Filed: Dec. 13, 1976

[51] Int. Cl.[3] ..... B65H 75/00; B65H 75/06

[52] U.S. Cl. ..... 242/54 R; 114/254; 242/85.1; 242/86.5 A; 242/96; 242/100

[58] Field of Search ..... 242/54 R, 96, 85.1, 242/86.5 A, 100, 99; 114/259, 260, 253, 254

[56] References Cited

U.S. PATENT DOCUMENTS

| | | | |
|---|---|---|---|
| 579,056 | 3/1897 | Gibbons et al. | 242/96 |
| 1,292,361 | 1/1919 | Obermiller | 242/96 |
| 1,783,159 | 11/1930 | Palmer | 242/96 |
| 1,950,745 | 3/1934 | Patterson | 242/96 |
| 3,138,356 | 1/1964 | McClain | 242/96 X |
| 3,143,316 | 8/1964 | Shapiro | 242/96 |
| 3,174,702 | 3/1965 | French | 242/96 X |
| 3,208,586 | 9/1965 | Wilson | 242/85.1 X |
| 3,638,876 | 2/1972 | Bullock | 242/86.5 A |

FOREIGN PATENT DOCUMENTS

| | | | |
|---|---|---|---|
| 1379377 | 10/1964 | France | 242/96 |

*Primary Examiner*—Stanley N. Gilreath
*Attorney, Agent, or Firm*—Alex Rhodes

[57] ABSTRACT

A water skiing tow apparatus for storing and controlling the release of a towline comprising a reel, adapted to be held by a water skier, in combination with a towline and means for connecting one end of the towline to the reel and the opposite end of the towline to a boat. A pair of handles extend outwardly from a take-up structure of the reel, the take-up structure being rotatable about the handles and configured such that when the reel is rotated about the handles the line of action of a force applied by the towline to the reel at least once per revolution of the reel passes approximately through the axis of rotation.

1 Claim, 6 Drawing Figures

WATER SKIING TOW APPARATUS

BACKGROUND OF THE INVENTION

Water skiing is a popular and exciting water sport in which persons on skis swiftly skim the surface of the water. Generally, a water skier holds a towbar which is connected by means of a towline to a power operated boat. Two areas requiring improvements are the storing and control of release and retrieval of the water skiing towline.

Towlines while not in use are generally stored in a loosely coiled manner causing them to be subject to fraying, knotting and tangling. When towlines are released and not being used for towing water skiers or are in the process of being retrieved, they may become tangled or snagged on objects present in the water such as weeds and boat propellors.

In some cases it is desirable to release and retrieve a towline in a controlled fashion. For example, initially a water skier must be accelerated to the speed of the towing boat. The usual start-up procedure in deep water is for the skier to first maneuver himself into a position in the water of sitting back on his skis with legs folded and knees touching his chest. As the pull of the towboat is applied, the skier must rise, slowly rocking forward on his heels until he assumes an upright position. The start-up procedure is difficult, especially for beginners, and unless it is smoothly executed without allowing slack to develop in the line, start-up may not be accomplished and the skier will sink into the water. It is apparent that an apparatus which would allow a controlled release of a towline while the pull of a boat is applied would be of benefit for accelerating a water skier.

Towlines generally are made 75 feet in total length; however, in some cases it is necessary or desirable to use lengths other than 75 feet. For example, group skiing requires optional towline lengths to effect a particular ski formation by the skiers. In another situation towline lengths of 40 to 50 feet are required for "trick skiing" in the wake of a towboat. Also, short towlines are sometimes used by experienced skiers in slalom skiing. In still another case, a shortened towline may be required for skiing in a confined area.

It is apparent that a water skiing tow apparatus having features for controlled release and retrieval of a water skiing towline, release of an optional length of towline and storage of a towline while the towline is not in use would be of benefit.

SUMMARY OF THE INVENTION

The present invention is directed toward an apparatus for water skiing comprising a reel, adapted to be held by a water skier a towline, and means for connecting one end of the towline to the reel and the other end of said towline to a boat. It is intended that the reel will be held by the water skier and used in place of a towbar. A pair of handles extend outwardly from parallel side members of the reel, said side members being interconnected by a take-up structure and said structure being configured to provide a point of departure of the towline from the structure which results in a torque about the handles of the reel varying at least once per revolution of the reel from a maximum to a negligible value when a force is applied by the towline, the line of action of said force passing approximately through the axis of rotation of the reel. It is an object of the present invention to provide an apparatus for the controlled release and retrieval of a water skiing towline so that a water skier may be accelerated smoothly to the speed of a towboat without developing slack in the towline.

It is a further object to provide a reel for water skiing towline whereby during the release of the towline, at least once per revolution of the reel a negligible torque is required to allow stopping the release of the towline at less than its total length. It is a further object to provide a means for protecting and storing water skiing towline while the towline is not in use. It is a still further object of the present invention to provide a reel which will float if dropped into the water.

Further features and benefits of the present invention will be apparent from the following description with reference to the accompanying drawings.

DETAILED DESCRIPTION OF THE INVENTION

Figure 1:
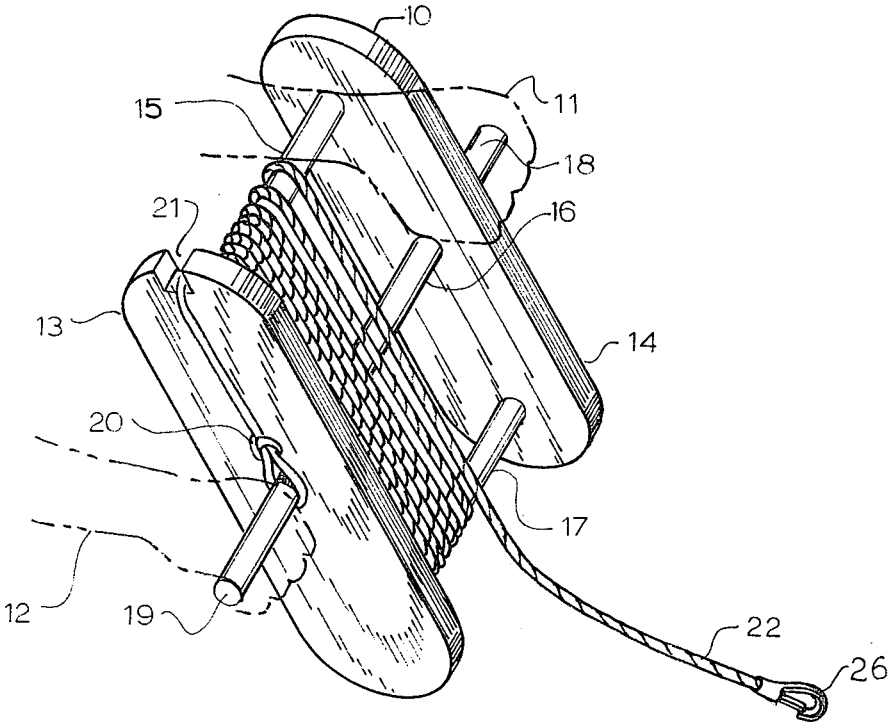
FIG. 1 is a perspective view of a water skiing tow apparatus embodying the present invention and displaying a reel operatively connected to one end of a towline and a means for attaching the towline to a boat connected to the opposite end of said towline.

With reference to the accompanying drawings, a water skiing tow apparatus embodying the present invention is generally shown in FIG. 1, wherein a reel designated by the numeral 10 is held by a pair of hands of a water skier 11 and 12. Reel 10 is comprised of a pair of vertically disposed parallel side-members 13 and 14 which are interconnected by a triad of horizontally disposed cylindrically shaped cross-members, said triad being an upper cross-member 15, a center cross-member 16 and a lower cross-member 17. Center cross-member 16 extends outwardly through side-members 13 and 14 to provide a pair of handles 18 and 19, said handles being rigidly connected to side-members 13 and 14 and not rotatable with respect to said side-members.

Reel 10 is shown constructed of separate wooden pieces rigidly joined together. Any common means of joining such as adhesive bonding, nails or screw fasteners may be used or other materials and constructions such as a single plastic molding substituted for the aforementioned wood construction. Preferably, reel 10 materials should have densities less than water so that reel 10 will float if dropped into the water.

Figure 2:
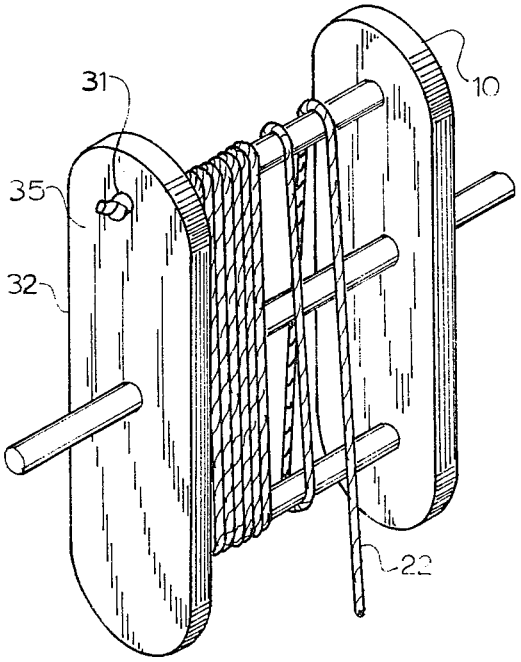
FIG. 2 is a perspective view of my water skiing tow apparatus displaying an alternate means of connecting the reel to the towline.
Figure 3:
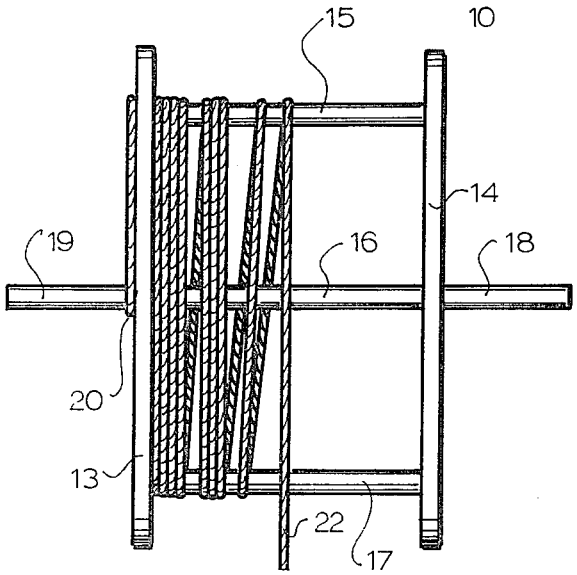
FIG. 3 is a side elevation view of the reel.

Towline 22 is attached to reel 10 by loop 20 and then threaded through notch 21 in side-member 13, said method of attaching and positioning towline 22 providing an improved means of promoting uniform winding and unwinding of towline 22 about reel 10. The opposite end of towline 22 is attached to clasp 26, said clasp 26 providing a means for attaching towline 22 to a boat 37. In FIG. 2 an alternate means of attaching towline 22 to reel 10 is shown whereby towline 22 is threaded through hole 31 in side-member 32 with knot 35 restraining towline 22 to reel 10.

With reference again to FIG. 1, side-members 13 and 14 cooperate to form a support structure for upper cross-member 15, center cross-member 16 and lower cross-member 17, said cross-members forming a take-up structure for towline 22 being configured to provide a point of departure for towline 22, such that, when a given force is applied by a water skier to towline 22, the line of action of said force passes approximately through the axis of rotation of reel 10 twice per revolution of said reel. It is apparent that when reel 10 is held by a water skier in the manner shown in FIG. 1 while a force is applied to reel 10 by towline 22, rotation of reel 10 may be controlled or prevented by friction from the pressure of hands 11 and 12 on handles 18 and 19.

The effort required for controlling or preventing rotation of reel 10 by pressure of hands 11 and 12 is dependent upon the distance from the axis of rotation of the line of action of the force applied by towline 22. It is also apparent that the configuration of the take-up structure of reel 10 wherein upper cross-member 15 and lower cross-member 17 are spaced relatively distant from each other minimizes the number of layers of towline 22 during winding and unwinding. This reduces the time required for retrieval and release of towline 22 without significantly affecting the distance at which the lines of action of towline 22 forces act from the axis of rotation through handles 18 and 19. Such is not the case wherein the take-up structure is a circular cross-section member. See Brayman U.S. Pat. No. 3,738,589 which teaches the use of a take-up structure having a circular cross-section.

Figure 4:
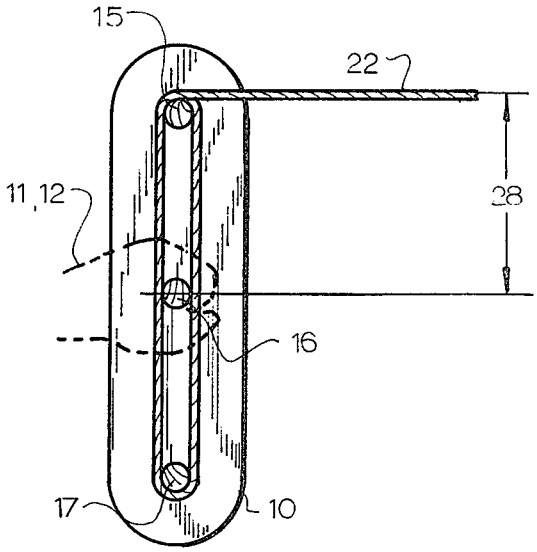
FIG. 4 is a cross-sectional view in the direction of arrows 4—4 of FIG. 3 wherein the reel is held in a position whereby the line of action of a force applied to the towline is farthest from the axis of rotation so as to produce a maximum torque about an axis passing through the handles by which the reel is held.
Figure 5:
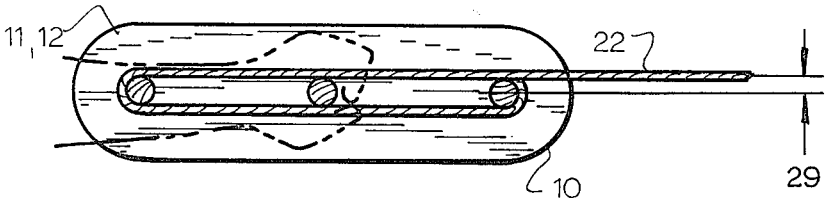
FIG. 5 is a cross-sectional view taken in the same direction as FIG. 4 but differing from FIG. 4 in that the reel is held in a position whereby the line of action of a force applied by the towline passes approximately through the axis of rotation of the reel so as to produce a negligible torque about an axis passing through the handles by which the reel is held.
Figure 6:
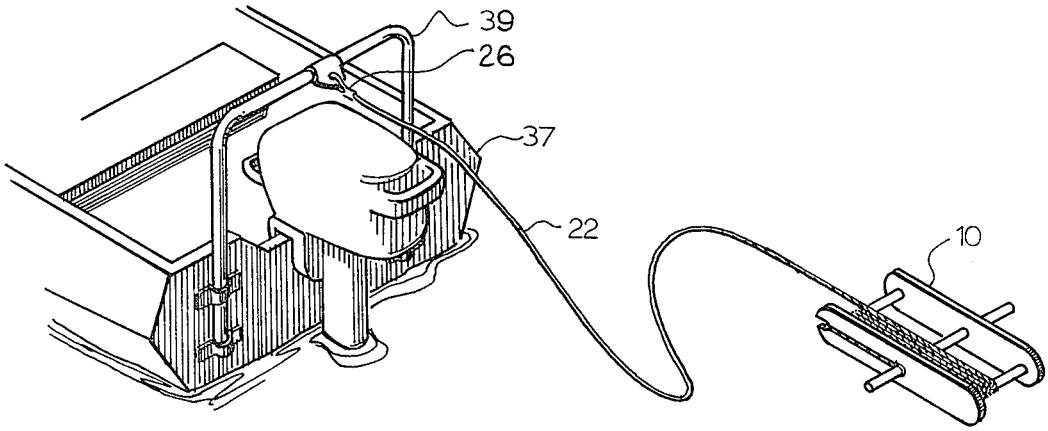
FIG. 6 is a perspective view of the second embodiment of the present invention wherein is displayed a combination towbar and reel operatively connected to one end of a towline and a towboat hitch connected to the opposite end of said towline

In FIG. 4, reel 10 is shown held in a position by hands 11 and 12 wherein the point of the departure of the line 22 is at a maximum distance 28 from the axis of rotation passing through handles 18 and 19 and the resulting torque about the axis is a maximum. Clearly, in this position a significant pressure is required by hands 11 and 12 to control or prevent rotation of reel 10 when a force is exerted by a water skier. With reference to FIG. 5, a position of reel 10 is shown whereby distance 29 of the line of action of the towline force from the axis of rotation is a minimum and release and retrieval of towline 22 may be easily controlled by pressure of hands 11 and 12 on handles 18 and 19.

While a single embodiment of the present invention has been shown, it will be appreciated that other embodiments drawing from individual features of the shown embodiments can be provided. For example, it is possible to construct the take-up structure of reel 10 from a plurality of cylindrically shaped cross-members of greater number than three. Also, the take-up structure may be constructed from the relatively thin single piece of width equal to the distance between side-members 13 and 14 and length equal to the distance between upper cross-member 15 and lower cross-member 17.

Having now described my invention and the manner and method of using it, one can see that what has been achieved is a water skiing tow apparatus for storing and controlling the release and retrieval of a water skiing towline.

What I claim is new is:

1. In combination with a water skiing tow apparatus of the type wherein a reel, adapted to be held by the two hands of a user, is rotatable about an axis during release of a towline wound onto said reel, the improvement wherein a boat hitch is attached to the end portion of the towline opposite said reel and said reel comprises a reel structure configured to provide a point of departure of the towline from said structure, such that, when a force is applied to the towline, the distance of the line of action of the force from said axis varies and passes approximately through said axis at least once per revolution of said reel, and a handle structure, aligned with said axis and non-rotatably affixed to said first mentioned structure, such that, each of the user's hands, during release of the towline, are disposed on opposite sides of said handle structure, whereby said hitch may be attached to the stern of a boat and the handle structure of said reel may be held by the two hands of a water skier for controlling the release of said towline.

* * * * *